US007919047B2

(12) United States Patent
Sinclair et al.

(10) Patent No.: US 7,919,047 B2
(45) Date of Patent: Apr. 5, 2011

(54) AIR DISPLACEMENT PIPETTER

(75) Inventors: James E. Sinclair, Carlsbad, CA (US); Michael P. Emery, Santee, CA (US); Minh Vuong, San Diego, CA (US)

(73) Assignee: Vertex Pharmaceuticals Incorporated, Cambridge, MA (US)

( * ) Notice: Subject to any disclaimer, the term of this patent is extended or adjusted under 35 U.S.C. 154(b) by 349 days.

(21) Appl. No.: 11/446,821

(22) Filed: Jun. 5, 2006

(65) Prior Publication Data

US 2007/0207062 A1 Sep. 6, 2007

Related U.S. Application Data

(60) Provisional application No. 60/778,759, filed on Mar. 3, 2006.

(51) Int. Cl.
*B01L 3/02* (2006.01)

(52) U.S. Cl. ..... 422/100; 73/863.32

(58) Field of Classification Search ..... 422/100; 73/863.32

See application file for complete search history.

(56) References Cited

U.S. PATENT DOCUMENTS

| | | | | |
|---|---|---|---|---|
| 4,268,481 | A * | 5/1981 | Suovaniemi et al. | 422/100 |
| 5,055,263 | A * | 10/1991 | Meltzer | 422/65 |
| 5,627,076 | A * | 5/1997 | Walker et al. | 436/30 |
| 5,948,359 | A | 9/1999 | Kalra et al. | |
| 6,247,891 | B1 | 6/2001 | Lind | |
| 6,254,826 | B1 | 7/2001 | Acosta et al. | |
| 6,258,324 | B1 * | 7/2001 | Yiu | 422/100 |
| 6,372,185 | B1 | 4/2002 | Shumate et al. | |
| 6,495,106 | B1 | 12/2002 | Kalra et al. | |
| 6,575,209 | B2 | 6/2003 | Gora | |
| 6,666,644 | B1 | 12/2003 | Lind et al. | |
| 6,846,456 | B2 | 1/2005 | Acosta et al. | |
| 6,846,680 | B2 * | 1/2005 | Friswell et al. | 436/180 |
| 2002/0086440 | A1 * | 7/2002 | Lehtinen et al. | 436/180 |
| 2002/0146353 | A1 * | 10/2002 | Bevirt et al. | 422/100 |
| 2005/0235762 | A1 * | 10/2005 | Sinclair | 73/864.01 |
| 2005/0244303 | A1 * | 11/2005 | Ingenhoven et al. | 422/100 |

* cited by examiner

*Primary Examiner* — Jill Warden
*Assistant Examiner* — Dwan A Gerido
(74) *Attorney, Agent, or Firm* — Knobbe Martens Olson & Bear LLP

(57) ABSTRACT

An air displacement pipetter comprises a guidance sleeve positioned within a hole in a cylinder block and a piston within a portion of the guidance sleeve a piston penetrating the cylinder block, a spring energized seal disposed within the cylinder block, a seal capture plate contacting the spring energized seal, a carrier plate, a pipette tip attached to the carrier plate, and a manifold plate between said carrier plate and said cylinder block.

6 Claims, 4 Drawing Sheets

AIR DISPLACEMENT PIPETTER

CROSS-REFERENCE TO RELATED APPLICATIONS

This application claims priority to provisional application 60/778,759 filed on Mar. 3, 2006.

BACKGROUND OF THE INVENTION

1. Field of the Invention

This invention relates to air displacement pipetters.

2. Description of the Related Art

Air-displacement array pipetters are used extensively in the life-science and biotechnology arenas. These are designed to pipette in the Microliter range into and out of 96, 384, and 1536 assay plates that conform to the SBS microplate standard.

As shown in FIG. 1, a typical array pipetter in the prior art consists of two parts. The first is a cylinder block 20 into which 96 or 384 pistons 22 are inserted into corresponding cylinders. The second is a tip array carrier 26 with pipetting tips 28 welded thereon. The tip array carrier 26 is mated to the cylinder block 20 with o-rings 30 to seal the tips 28 to their corresponding cylinders. This mating can be done statically by bolting the tip array carrier 26 to the cylinder block 20 or dynamically by using a robotic or other motorized mechanism to pick up the carrier 26 and fasten it to the cylinder block 20. In use, the pistons 22 are coupled at their top ends to a robotic mechanism (not shown) that raises and lowers the pistons (typically all at once) to perform pipette operations to and from wells of multi-well plates. Typically, a pipetter includes an array of 96 or 384

There are many disadvantages to this basic design. For example, a large number of o-rings 30 are needed to seal the tip array carrier 26 to the cylinder block 20. When the array carrier 26 is removed from the cylinder block 20, many of these o-rings 30 may stick to the mating surface on the cylinder block 20 and are thus removed from their seat grooves in the array carrier 26. If automated tip array changing is implemented, any such loss of o-rings is unacceptable, as it will cause at least a partial loss of sealing. Even in the case of static mating, the situation is far from ideal because installing 96 or especially 384 small o-rings 30 is a burdensome task for the user.

Furthermore, welding the tips 28 to an array carrier 26 results in a very rigid architecture. If one tip is damaged, the entire array carrier has to be replaced. Moreover, the array of 96 or 384 tips has to be used in its entirety. Selective pipetting to or from a subset of wells in a plate is not possible. For example, to perform serial dilution one may want to pipette from one row of wells to another row. This is impossible with a welded array carrier 26 that carries a complete rectangular array of tips 28.

SUMMARY OF THE INVENTION

The invention includes several different embodiments of air displacement pipetters and methods of making air displacement pipetters.

In one embodiment, such an air displacement pipetter comprises a guidance sleeve positioned within a hole in a cylinder block and a piston positioned within the guidance sleeve.

In another embodiment, an air displacement pipetter comprises a cylinder, a piston penetrating the cylinder, a spring energized seal disposed within the cylinder; and a seal capture plate contacting the spring energized seal.

In a further embodiment, an air displacement pipetter comprises a carrier plate;

a pipette tip attached to the carrier plate, and a manifold plate between the carrier plate and the pipette tip.

A method of making an air displacement pipetter comprises inserting a pipette tip into a carrier plate, attaching a manifold plate to the carrier plate, and coupling multiple cylinders and/or pistons to the pipette tip.

Another method of making an air displacement pipetter comprises inserting one or more sleeves into one or more corresponding cylinders of a cylinder block, inserting one or more seals on top of the sleeves, and inserting one or more pistons into the seals and sleeves. A first plate is placed over an upper portion of the pistons, the first plate containing holes through which the upper portions of the pistons extend. The one or more pistons are secured to the first plate. A second plate is placed over an upper portion of the pistons, the second plate containing holes through which the upper portions of the pistons extend. The one or more pistons are then secured to the second plate.

BRIEF DESCRIPTION OF THE DRAWINGS

These and other aspects of the invention will be readily apparent from the description below and the appended drawings, in which like reference numerals refer to similar parts throughout, which are meant to illustrate and not to limit the invention, and in which.

DETAILED DESCRIPTION

Figure 1:
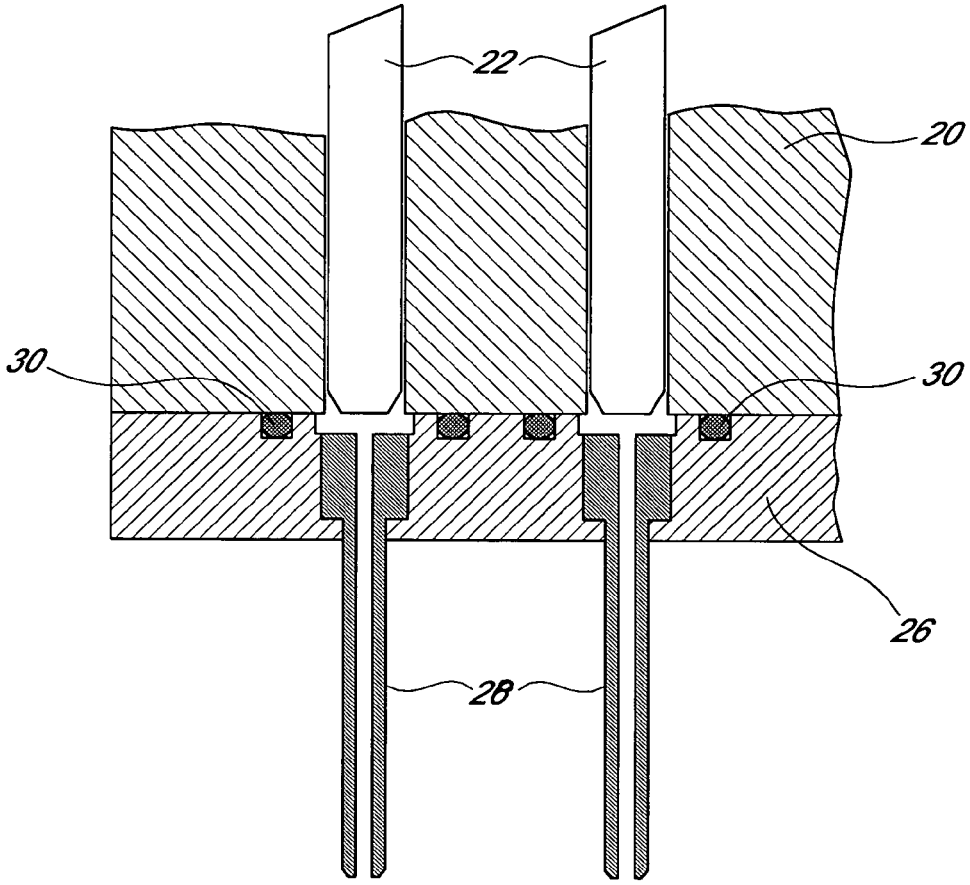
FIG. 1 (PRIOR ART)
FIG. 1 is a cut-away view of a typical array pipetter.
Figure 2A:
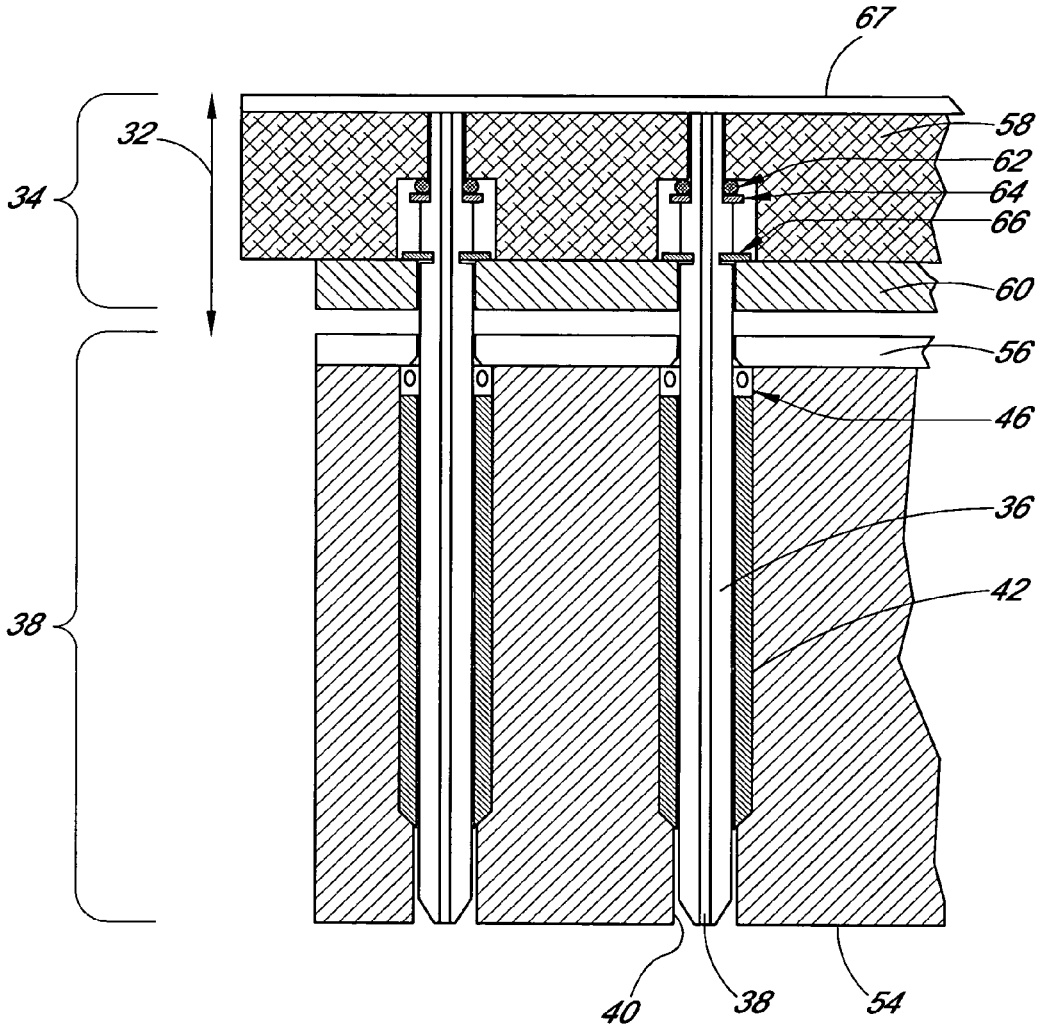
FIG. 2A is a cut-away view of a pipetter of the present invention.
Figure 2B:
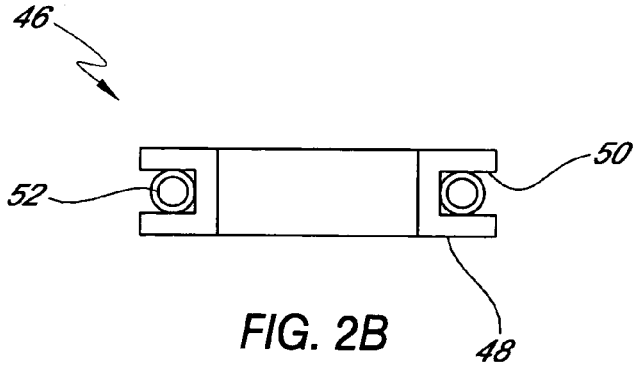
FIG. 2B is a detail cut-away view of the seal of FIG. 2A
Figure 3:
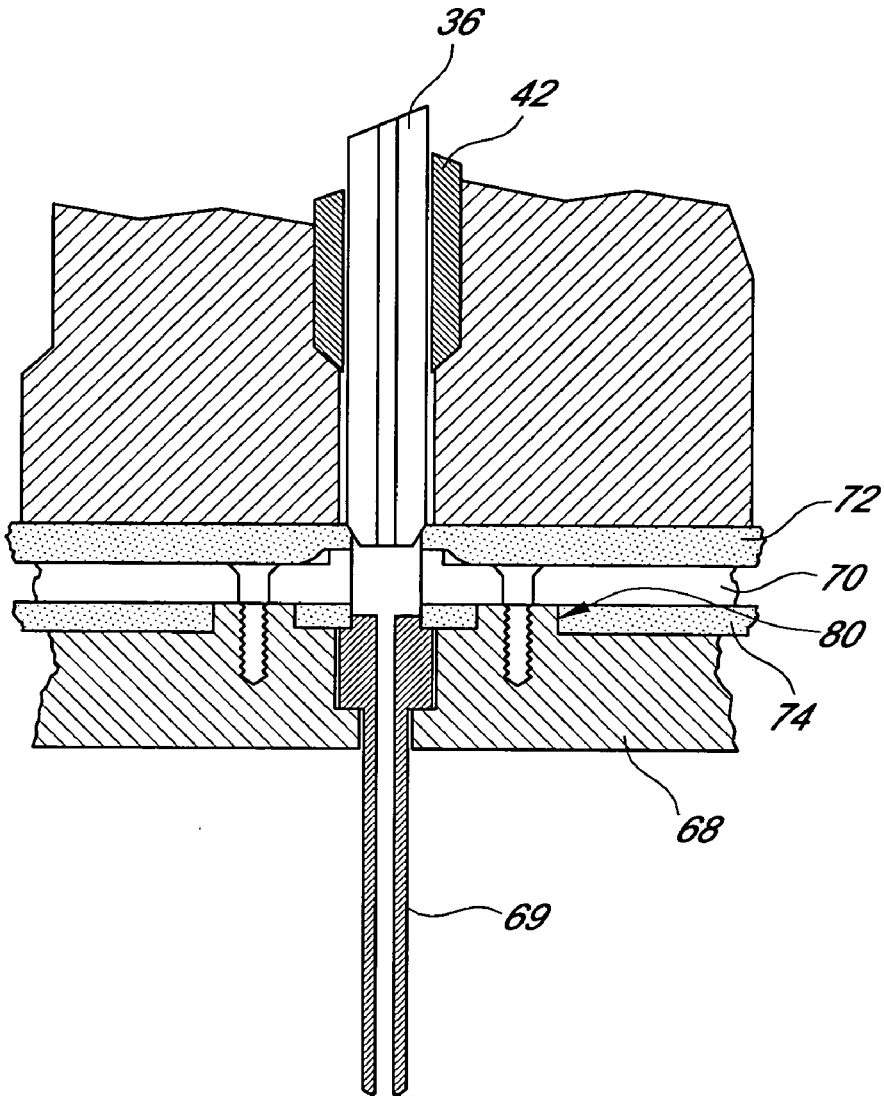
FIG. 3 is a cut-away close-up view of a tip array carrier of the present invention.

Many of the above described drawbacks of the prior art are resolved by the embodiments of the invention illustrated in FIGS. 2-4. FIG. 2 illustrates an embodiment of a cylinder block and actuating portion of a pipetting device. FIGS. 3 and 4 illustrate embodiments of a tip array carrier portion of a pipetting device. The features of these two portions are advantageously utilized together in a single pipetter, but the features described herein have separate utility, and can be used in any of various combinations with each other and in pipetters that include otherwise conventional features.

Referring now to FIG. 2A, the upper portion of the pipetting device includes an actuating portion 34 that is attached to a set of pistons 36 in a cylinder block portion 38. In operation, the actuating portion, described in greater detail below and as shown by arrows 32, moves up to raise the pistons and aspirate liquid from the wells of a multi-well plate, and moves down to dispense aspirated liquid into wells of a multi-well plate.

The cylinders 40 of the cylinder block 38 are provided with guidance sleeves 42 that line a portion of each cylinder 40, and the pistons 36 are sealed at the top of the cylinders 40 with spring energized u-cup seals 46 instead of o-rings. In this embodiment, each seal 46 may made of Teflon and incorporates a preloaded spring that provides a constant grip on the piston 36. A cross section of such a u-cup seal 46 is illustrated in FIG. 2B. A polymer material 48 such as Teflon is formed with a channel 50. A spring 52 resides in the channel. Seals with this construction are commercially available from, for example, Bal Seal Engineering of Foothill Ranch Calif.

Sealing of the pistons 36 is accomplished through the use of these u-cup seals 200 because each cylinder's bore is large enough such that there is no contact between it and its cognate piston 36. It is not economically feasible to use a tight fit between the piston and the metallic cylinder block—both of which are metallic, to achieve sealing action. Because the bore 40 has a larger diameter than the piston 36, if the design only consisted of piston 36, cylinder block 38, and u-cup seal 46, when the piston 36 is at its bottom-most position near the tip mating surface 54, the end of the piston might well be significantly off centered with respect to the cylinder. For reasons described more fully below, it is advantageous for the tip of the piston at this position to be as centered as possible within its cylinder 40. To help center the piston within the cylinder, the guidance sleeve 42 is provided. The inner diameter of this sleeve 42 is less than that of the cylinder and is very close to that of the piston 36. This closer fit around the piston is not enough to provide sealing action but is sufficient to force the piston 36 to be reliably concentric with the cylinder. The sleeves 42 are made of a low-friction material such as nylon or acetal (Delrin) because if there is some residual concentric misalignment, slight rubbing between the two parts may occur. In addition to providing piston 36 alignment at the bottom-most position, the guidance sleeve 42 also helps with alignment at the seal position, protecting the u-cup seal 46 from damage that might occur if there were significant non-concentricity between seal 46 and piston 36. The u-cup seals 46 are captured between the guidance sleeves 42 and a seal capture plate 56 that has an array of openings matching the array of bore holes 40.

This portion 38 of the apparatus is manufactured by machining bore holes through the cylinder block which are deeply countersunk to hold the guidance sleeves. The guidance sleeves are inserted into the bore holes to the bottom of their channels. The u-cup seals are installed into the bore holes onto the top of the guidance sleeves. The seal capture plate 56 may then be bolted onto the top of the cylinder block with its holes aligned with the bore holes in the cylinder block.

The tops of the pistons 36 are captured between an upper movable plate 58 and a lower moveable plate 60 via an o-ring 62, a washer 64, and an e-clip 66. When the two moving plates 58, 60 are attached (usually bolted), together, the o-ring 62 is compressed and the e-clip 66 is forced against moving plate 60. The through holes in both moving plates 58, 60 are large enough to allow the pistons 36 to float laterally. At the top of the assembly is a flexible membrane 67 that covers the tops of cleaning channels 38 that are formed through the pistons. The flexible membrane 67 is used to allow a flow of cleaning fluid from the tops of the pistons through the channels 38 and out the bottom of the pistons to clean the pipette tips attached to the pistons. When the flexible membrane 67 is pulled away from the upper plate 58 during flow-through washing, cleaning fluids flow into the cavity and down through the pistons and out of the pipette tips. This aspect of the system illustrated in FIG. 2 is described in detail in U.S. patent application Ser. No. 10/833,496, now U.S. Pat. No. 7,077,018, filed on Apr. 27, 2004, and hereby incorporated by reference in its entirety.

To complete the assembly of both sections 34 and 38 of the apparatus, the pistons 36 are first inserted through the holes in the seal capture plate 56 and into the u-cup seals 46, where they are allowed to find their optimal lateral positions within the u-cup seals 46. Then the assembly of the two moving plates 58, 60 is undertaken. First, openings in the lower plate 60 are aligned with the pistons 36 and the lower plate 60 is placed over the pistons to rest on the seal capture plate 56. The pistons are then retained on top of the lower plate 60 by plastic or metal deforming e-clips that are pressed into a slot on the piston above the lower plate 60. The e-clips have an outer diameter larger than the holes in the lower plate so that when the lower plate 60 is raised, the pistons rise with it. Washers 64 and o-rings 62 are then placed on shoulders of the pistons. Then the upper plate 58 is placed over the pistons and onto the lower plate, compressing the o-rings between the bottom of a countersunk cavity in the upper plate and each washer 64. The upper plate is then bolted or otherwise secured to the lower plate 60. Because the through holes in these two moving plates have diameters larger than the portion of the pistons they are placed over, this second assembly will not perturb the optimal lateral positions that the pistons 36 have found for themselves when first inserted into the u-cup seals 46. In addition to securing the floated pistons 36 in place, the compressed o-ring 62 also provides sealing between the piston body 36 and the upper moving plate 56, thus maintaining continuity of the backwash cleaning system described above. This manufacturing process is advantageous as there are many sources of concentricity errors in the cylinder block 54. The u-cup seals 46 cannot be guaranteed to be perfectly concentric. The center-to-center distance between cylinders cannot be perfectly uniform across 384 units, the perpendicularity among cylinders must have some imperfection, etc.

This embodiment fulfills three main requirements. First, when 384 pistons arrayed in a rectangular matrix must penetrate into 384 cylinders, precise alignment is difficult. Any minor machining error in the piston array will result in misalignment for at least some of the pistons, which will cause excess wear and tear in the piston seals and/or leakage. The sleeves 42 and u-cup seals 46 help minimize these problems. Second, o-rings are conventionally used to provide sealing of the pistons but they are prone to failure. Replacing just one o-ring would require dismantling the entire pipetting head. The u-cup seals are more reliable than o-rings. Third, especially when flow-through washing capability is implemented, it is desirable to make their tips as concentric with the cylinder cross section as possible at the lower portion of their travel path.

In preferred embodiments, the cylinder block/piston actuator described above is coupled to a novel tip array carrier. This is illustrated in FIG. 3. In this embodiment, the tip array carrier comprises four main components. These are a carrier plate 68 holding the pipette tips and into which the piston ends are inserted, an intermediate manifold plate 70, two gasket mats 72, 74, and the pipette tips 69 themselves. Instead of using individual o-rings around each pipette tip, the gasket mats 72, 74 perform the sealing function between the cylinder block and the tip array carrier. These may be made out of DMSO-resistant materials such as Chemraz and laser cut to achieve a desired hole pattern. In essence, one could think of these mats 72, 74 as o-rings that have been combined together into a single unit. In this embodiment, pipetting tips 69 are not soldered or welded to the carrier plate 68 but only inserted into counterbored through holes. Thus, individual tips 69 can be easily replaced or even omitted to allow for varying configurations of the same basic rectangular array.

An important aspect of the embodiment illustrated in FIG. 3 is the manifold plate 70. The manifold plate contains channels that couple the pistons to the pipette tips. When the cylinder block and the pipette tip array are the same, the channels can be simply through holes connecting a piston to a corresponding cylinder. However, even though a tip array carrier with 384 tip mounting points can be fitted with 24, 96 or 384 tips, it is not feasible to design cylinder blocks with variable numbers of cylinders and pistons 102. Hence the cylinder block and piston arrays are designed as separate fixed rectangular matrices of 24, 96, or 384 units. The manifold plate 70 is used to couple tip carriers with fewer than 384 tips to a cylinder block 54 with 384 pistons.

Figure 4A:
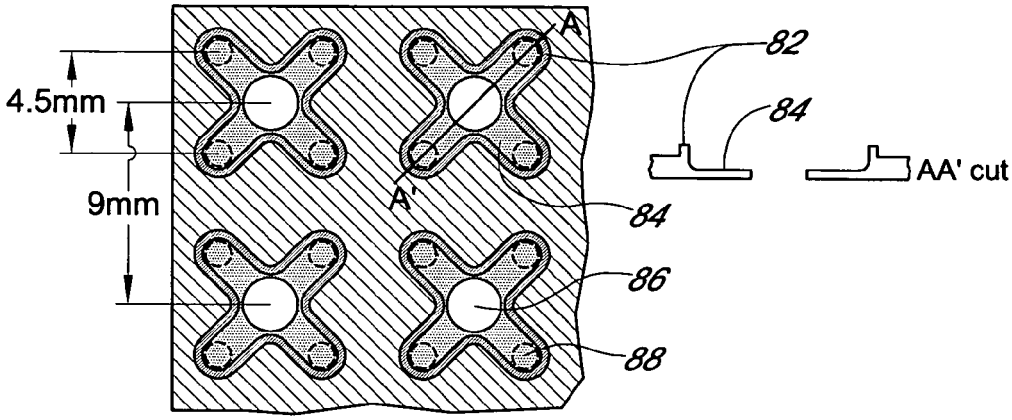
FIG. 4A is a combination top view of a manifold plate and a cut-away relief view of the manifold plate along the line A-A.

FIG. 4 illustrates a manifold plate 70 that can be used to mate a 96-tip array to the 384-unit cylinder block. FIG. 4A illustrates how each tip 69 is addressed by four cylinders. The dark gray area is above the hatched area and represents a seal boss 82 used to reduce the force needed to provide proper sealing (described further below). The light gray area is below the hatched area and forms the channel that allows four cylinders to address the single pipetting tip. This embodiment illustrates the tip location 86 and its corresponding four piston locations 88. Looking down on the manifold plate as in FIG. 4A, during use, the pistons travel up and down together, with each group of four pistons 88 aspirating and dispensing fluid into and out of a single pipette tip couple to the pistons through the opening 86 in the manifold plate.

This manifold plate 70 provides a lot of flexibility in configuring the tip array. Almost any arrangement of tips 69 can be made to work. There are assay plates whose footprints conform to the SBS standard but whose well arrays do not. In particular, the 24 wells of a Caco-2 assay plates are arranged in a rectangular array with a pitch of 19.3 mm, which is non-standard as the SBS basic pitch is 9 mm or multiples and fractions thereof. It is very easy to design a 24-tip array of this non-standard pitch and use an appropriate manifold plate 70 to mate it to the 384-unit cylinder block 54. Using a manifold plate 70 is advantageous not only because it allows fewer than 384 tips to be addressed by 384 cylinders and pistons, but also because the manifold plate 70 allows several cylinders and pistons to be coupled to one tip 106, thus increasing the volumes that can be pipetted.

While the use of gasket mats 72, 74 overcomes the problem posed by individual o-rings, given the large surface area involved, a high compression pressure would be required to achieve proper sealing. If automated tip array changing is implemented, the tip array carrier is dynamically attached to the cylinder block, and this need for a high compression pressure can be a major obstacle as the required force may be beyond what a reasonable mechanism can achieve.

This issue is addressed in two ways. First, the manifold plate is attached 70 (in this embodiment bolted) to the carrier plate 68 in a non-dynamic manner. Thus, the compression pressure required for the lower gasket mat 74 does not have to be provided by any mechanism needed for automated tip array changing. In order to precisely define the compression percentage of the lower gasket mat 74 and to keep the relatively thin manifold plate 70 flat, compression stops 80 are machined into the carrier plate. Compression stops 80 are raised islands on which the manifold plate 70 rests. The heights of the compression stops 80 are less than the uncompressed thickness of the lower gasket mat by a precise amount and thus precisely control the lower gasket 74 compression. The compression of the lower gasket mat 74 is determined not just to provide a tight seal but also to prevent any loose motion by the tips 69.

Second, as sealing is only needed in the areas around the cylinders, the manifold plate is machined with seal bosses 82 in those areas. Thus the effective compression area is greatly decreased, resulting in a significant reduction in the force needed to achieve sealing.

Figure 4B:
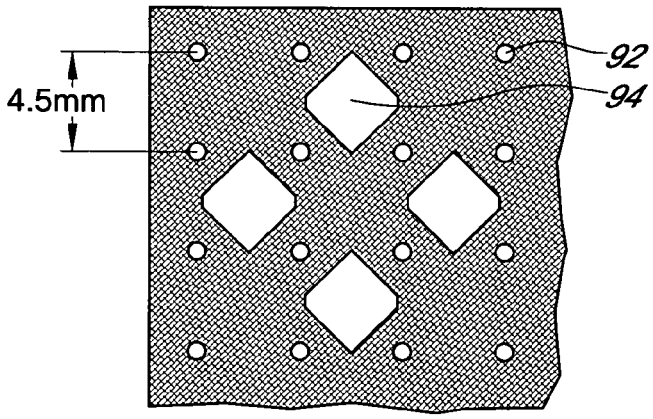
FIG. 4B is a top view of an upper gasket mat for the manifold plate of FIG. 4A.

FIG. 4B illustrates the upper gasket mat 72 for the manifold plate 70 in FIG. 4A. In this embodiment, the upper gasket mat 72 has a piston access hole 92 and a seal relief area 94. The upper gasket mat 72 provides a seal during the above described tip washing procedure. During washing, fluids flow through the piston's hollow core and into the pipetting tip. But these fluids may wet the inside of the cylinder if they become trapped, and thus, might cause contamination and/or corrosion. One way to avoid this is to rest the end of the piston 36 on the upper gasket mat 72 so that a seal is formed there. This requires that the tip be well aligned with the corresponding hole in the upper gasket mat 304, a requirement that can be satisfied if the piston 36 is concentric with the cylinder at its bottom-most position near the tip mating surface.

With a pipetting system capable of automated tip array changing, multiple tip array and manifold configurations can be used within the same pipetting protocol, all driven by the same 384-piston head assembly. For example, to do compound titration in a 96-well plate, a tip array with a single column of 8 tips 106 is first used to perform serial dilution across the 12 columns. This tip array carrier is then exchanged for a full 96-tip array to replicate the master plate into several daughter plates. Such a protocol would be impossible without individually configurable tip arrays and flexible manifold design.

It will be appreciated by those skilled in the art that various modifications and changes may be made without departing from the scope of the invention. Such modifications and changes are intended to fall within the scope of the invention, as defined by the appended claims.

What is claimed is:

1. An air displacement pipetter comprising:

a carrier plate;

at least a first pipette tip attached to said carrier plate;

a cylinder block comprising a plurality of cylinders aligned with said carrier plate;

a plurality of pistons positioned in said cylinders;

a manifold plate between said carrier plate and said cylinder block, wherein channels and openings in said manifold plate simultaneously couple multiple cylinders and/or pistons to said first pipette tip, such that depressing multiple pistons causes flow only through said first pipette tip; and at least one gasket disposed between said manifold plate and said cylinder block;

wherein said manifold plate, is machined with seal bosses extending toward said cylinder block, wherein said seal bosses are positioned to locally compress said gasket around said channels and openings in said manifold plate.

2. The air displacement pipetter of claim 1 further comprising at least one compression stop on said carrier plate.

3. The air displacement pipetter of claim 1 further comprising at least one pipetting tip positioned within a counterbored through hole in said carrier plate.

4. The air displacement pipetter of claim 1 further comprising at least one gasket mat disposed between said manifold plate and said carrier plate.

5. The air displacement pipetter of claim 4, wherein said at least one gasket mat comprises a hole pattern.

6. The air displacement pipetter of claim 4, wherein said at least one gasket mat is configured to provide sealing.

* * * * *